United States Patent [19]

Vietrogoski et al.

[11] Patent Number: 4,709,608

[45] Date of Patent: Dec. 1, 1987

[54] APPARATUS FOR SECURELY HOLDING A LOAF FOOD PRODUCT DURING SLICING

[75] Inventors: Charles J. Vietrogoski; Richard Obarowski; Paul J. McDonough, all of Dover, Del.

[73] Assignee: General Foods Corporation, White Plains, N.Y.

[21] Appl. No.: 862,883

[22] Filed: May 13, 1986

[51] Int. Cl.[4] ..... B26D 7/01

[52] U.S. Cl. ..... 83/355; 83/449

[58] Field of Search ..... 83/449, 446, 444, 355, 83/356.3

[56] References Cited

U.S. PATENT DOCUMENTS

| | | | |
|---|---|---|---|
| 2,100,021 | 11/1937 | Bell | 83/446 |
| 3,318,351 | 5/1967 | Werder | 83/446 X |
| 3,491,807 | 1/1970 | Underwood | 83/449 X |
| 3,492,899 | 2/1970 | Baldwin | 83/449 X |
| 4,015,494 | 4/1977 | Spooner et al. | 83/76 |
| 4,228,963 | 10/1980 | Yamauchi et al. | 83/446 X |
| 4,644,838 | 2/1987 | Samson et al. | 83/446 X |

*Primary Examiner*—Frank T. Yost

*Attorney, Agent, or Firm*—Sam D. Walker; Thomas R. Savoie; Daniel J. Donovan

[57] ABSTRACT

A method and apparatus for holding a loaf food product in order to allow an automatic slicing system to slice the loaf to preset slice thicknesses. The loaf food product is securely held by a pair of loaf engaging members which are fastened to the inner edges of conveyor guide rails a short distance from the slicing apparatus. The members prevent the butt end of the loaf from being improperly sliced.

14 Claims, 3 Drawing Figures

APPARATUS FOR SECURELY HOLDING A LOAF FOOD PRODUCT DURING SLICING

BACKGROUND OF THE INVENTION

The present invention relates to a method and apparatus for holding a loaf food product, such as a loaf of bread, to allow an automatic slicer to slice the loaf into preset slice thicknesses. More particularly, the invention relates to an improved method and apparatus for automatically slicing bread loaves using devices which are presently used to automatically slice bread and other loaf food products.

When one attempts to slice bread loaves or other irregularly shaped loaf food products using conventional automatic slicers, the butt ends of the loaf often do not get sliced properly. The unevenly sliced butt end leads to problems such as the jamming of equipment, or to a sliced loaf food product that is neither functionally useful nor aesthetically pleasing.

U.S. Pat. No. 4,015,494 (Spooner, et al.) is an example of a continuous slicing machine which exhibits the problem solved by the present invention. The loaf food product is secured in place during slicing by a hold down plate. However, when only the butt end of the loaf remains, the hold down plate is raised and the butt end is carried away without being sliced.

U.S. Pat. No. 4,321,847 (Dillon) employs a suction cup apparatus which moves along the conveyor path with the loaf food product to engage the butt end of the loaf and and to ensure proper slicing. The suction cup must be lifted out of the path and returned to a position behind each succeeding loaf to be sliced. This relatively complex device requires both energy to power the apparatus and time to raise the place the suction cup in the proper position.

It is the principal object of the present invention to provide a method and apparatus for slicing a loaf food product such as bread, which device has the capability of evenly slicing the entire loaf food product, including the butt end, into slices of a desired slice thickness.

It is a further object of the invention to provide a simple and inexpensive means for securely holding the butt end of a loaf food product in order to allow slicing of the butt end into a desired slice thickness.

It is yet a further object of the present invention to provide a stationary means for securely holding the butt end of a loaf food product while it is sliced.

It is another object of the present invention to provide a method for holding a loaf food product to insure that the butt end of the loaf is sliced into a desired slice thickeness.

SUMMARY OF THE INVENTION

The present invention provides an improvement in apparatus for automatically slicing a loaf food product, the apparatus comprising:

slicing means comprising a slicing blade for slicing a loaf food product;

conveyor means for conveying a loaf food product along a path to said slicing means for slicing a loaf food product;

means for automatically actuating said slicing means for producing slices of the loaf food product having a desired slice thickness; and a pair of guide members located on opposite sides of said path for guiding a loaf food product along said path and for preventing lateral displacement of a loaf food product from said path. The objects mentioned above and others that will be apparent to those skilled in the art are achieved in accordance with the present invention by providing, in such apparatus, a pair of loaf-engaging members, each of said loaf-engaging members extending longitudinally along one of said guide members and having an inner edge tapering generally inwardly into said path and away from said guide members in a direction towards said slicing means, each of said loaf-engaging members being positioned upstream of said slicing means and having a loaf-engaged area, said loaf-engaging area being spaced upstream of said slicing means a distance not greater than said desired slice thickness.

The present invention also provides an improved method for slicing a loaf food product in which a loaf food product is conveyed aong a path to a slicing means where the conveyed loaf is automatically siced into slices of a desired slice thickness. The method is improved in accordance with the invention by providing, at a location upstream of the slicing means, a pair of loaf-engaging members, each of said members being located at a side of said path and having an inner edge tapering towards the slicing means, each of said members having a loaf-engaging area spaced upstream of said slicing means a distance not greater than the desired slice thickness, whereby said loaf-engaging members engage a loaf food product, including the butt end thereof, as it is being sliced.

DESCRIPTION OF THE PREFERRED EMBODIMENT

The automatic sliding system of the present invention includes a conveyor means 10 for conveying a loaf food product along a path to a slicing means 11. The slicing means 11 preferably comprises a rotating involute knife slicer, although other slicing means are compatible with the present invention.

Figure 1:
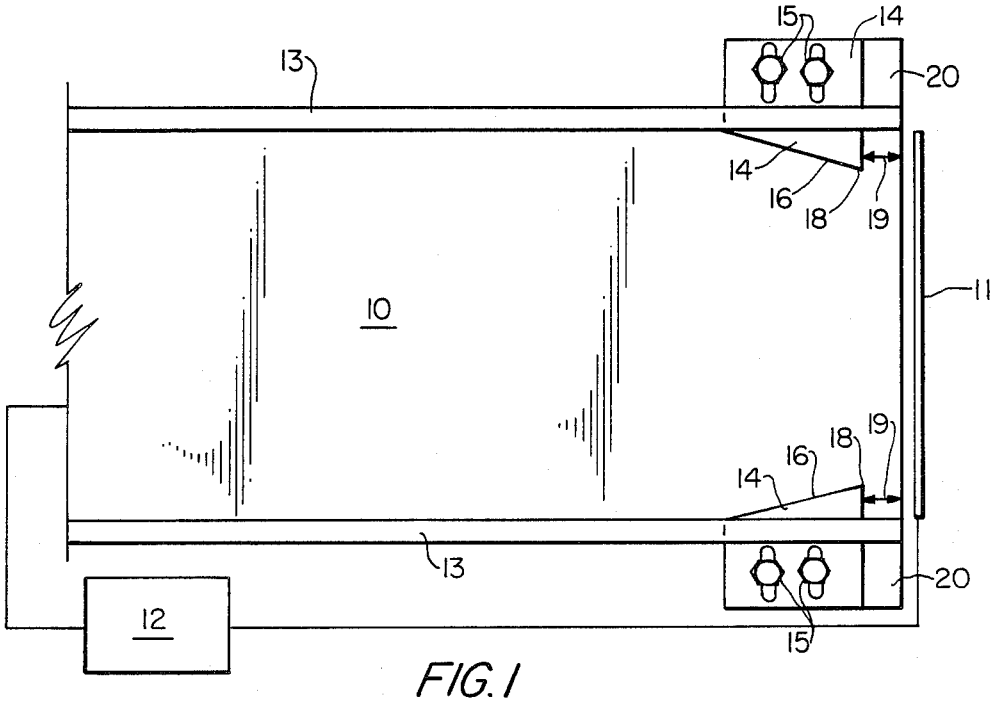
FIG. 1 is a top plan diagrammatic view of the slicing apparatus according to the invention.

The automatic slicing system of FIG. 1 also includes an automatic actuating means 12 which will synchronize the speed of the conveyor means 10 and the speed of the slicing means 11 in order to produce substantially even slices of a desired thickness. The automatic actuating means 12 is preferably adjustabe in order to provide the slicing system the capability of producing slices of different desired thicknesses.

The conveyor means 10 incudes guide members 13 which may be a pair of parallel rails as shown, one on either side of the conveyor means 10. One of these guide members 13 may be adjustable such that it may be moved closer to, or farther from the other guide member 13. This feature will allow the automatic slicing system to accomodate loaf food products having different widths. The guide members 13 serve to guide the food loaves towards the slicing means 11 by preventing lateral displacement of the loaves from the conveyor path between guide members 13 leading to the slicing means 11.

Figure 2:
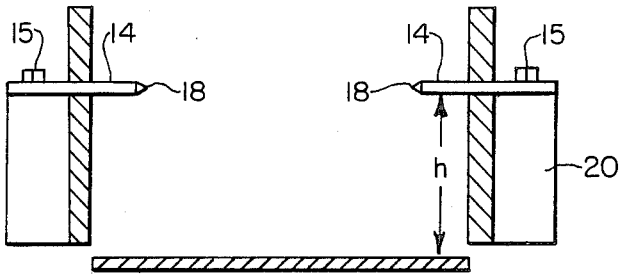
FIG. 2 is a diagrammatic end elevation view of the device of FIG. 1.
Figure 3:
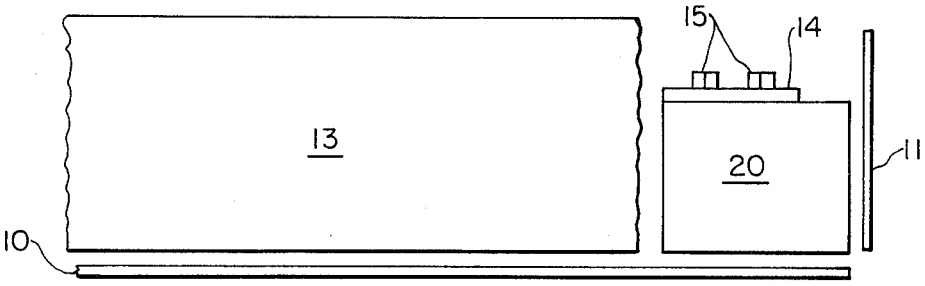
FIG. 3 is a diagrammatic side elevation view of a portion of the device of FIG. 1.

A pair of loaf engaging members 14 are attached to the inside of the guide members 13 in any suitable manner. The preferred means of attachment is to mount the loaf engaging members 14 to blocks 20 which are approximately 1" high and are attached to the guide members 13 on the side opposite the conveyor 10. The loaf-engaging members 14 are attached to the blocks 20 such that they extend into the conveyor path at a height "h" (FIG. 2) above the conveyor. Height "h" is preferably about 25–75% of the height of a loaf food product to be sliced, more preferably about 50%. The loaf-engaging members 14 may be adjustably or permanently attached to the blocks.

The loaf-engaging members 14 of the preferred embodiment are right triangular planar members fabricated from hardened steel. The loaf-engaging members 14 extend longitudinally along the guide members 13 and have an inner edge 16 which tapers generaly inwardly into the conveyor path and away from the guide members 13 in the direction of the slicing means 11. In a preferred embodiment, the inner edge 16 tapers inwardly at a 17° angle from the guide members 13.

Each loaf-engaging member 14 includes a loaf-engaging area 18 which is defined as the portion of the inner edge 16 of the loaf-engaging member 14 which extends the furthest inward from the guide members 13. The loaf-engaging area 18 is preferably located at the furthest downstream (i.e. towards slicer 11) point of the inner edge 16 of the loaf-engaging members 14. In any case, the loaf-engaging area 18 is positioned upstream of the slicing means 11 a distance 19 not greater than a desired slice thickness. The loaf-engaging members 14 are preferably spaced a distance 19 which is less than the desired preset slice thickness and more particularly a distance 19 which is approximately 25–75% of a desired slice thickness. In one embodiment of the invention, distance 19 is about ½ of a desired slice thickness.

Preferably, each loaf-engaging area 18 extends inwardly of the guide members 13 a distance of not more than 10% of the width of the path, and more preferably not more than 5%. The distance which the loaf-engaging area 18 extends inwardly from the guide members 13 may be adjusted by loosening wing nuts or the like attaching the loaf-engaging members 14 to the blocks 20, and sliding the loaf-engaging members 14 to the desired position. The slots 15 in the loaf-engaging members 14 allow for the positional adjustment of the loaf-engaging members 14. Longitudinal adjustment of members 14 may be provided by providing longitudina adjustment of blocks 20. Blocks 20 may also be vertically adjustable to vary the height "h" of members 14 above the surface of the conveyor.

It has also been found that the loaf-engaging members 14 function best when they are fixed, in use, in a substantially horizontal plane as illustrated in the drawings. The inner edge 16 of the loaf-engaging members 14 are preferably sharpened and have a bevel of approximately 30 degrees. Also, the inner edge 16 is preferably a straight edge although it may be curved, jagged, or other shape.

The present invention also includes a method which employs the previously described apparatus. The method comprises slicing a loaf food product which is conveyed along the conveyor means 10 to the slicing means 11 and providing the aforementioned loaf-engaging members in the conveyor path. The loaf-engaging area 18 of members 14 will exert a squeezing force on the loaf food product sufficient to hold the butt end of the loaf while it is being sliced. This squeezing force is particularly useful to hold the butt end of the loaf in place as it is being sliced. In the absence of loaf-engaging members 14, it is difficult to hold the butt end of the loaf. As a consequence, the butt end may simply fall backwards onto the conveyor. This is clearly a problem in itself and can lead to other problems such as interfering with normal operation of additional processing equipment, such as dicer, designed to handle slices of the loaf food product.

The foregoing includes a description of a preferred embodiment of the invention. Changes may be made without departing from the spirit and scope of the invention.

What is claimed is:

1. In apparatus for automatically slicing a loaf food product, said apparatus comprising:

slicing means comprising a slicing blade for slicing a loaf food product;

conveyor means for conveying a loaf food product along a path to said slicing means for slicing a loaf food product;

means for automatically actuating said slicing means and said conveyor means for producing slices of the loaf food product having a desired slice thickness; and a pair of guide members located on opposite sides of said path for guiding a loaf food product along said path and for preventing lateral displacement of a loaf food product from said path;

the improvement which comprises:

a pair of loaf-engaging members, each of said loaf-engaging members extending longitudinally along one of said guide members and having an inner edge tapering generaly inwardly into said path and away from said guide members in a direction towards said slicing, each of said loaf-engaging members being positioned upstream of said slicing means and having a loaf-engaging area, said loaf-engaging area being spaced upstream of said slicing means a distance not greater than said slice thickness.

2. Apparatus according to claim 1 wherein said distance is less than said desired slice thickness.

3. Apparatus according to claim 1 wherein said distance is from 25% to 75% of said desired slice thickness.

4. Apparatus according to claim 1 wherein said distance is approximately 50% of said desired slice thickness.

5. Apparatus according to claim 1 wherein each of said loaf-engaging areas extends inwardly of said guide members a distance of not more than 10% of the width of said path.

6. Apparatus according to claim 5 wherein each of said loaf-engaging areas extends inwardly of said guide members a distance of not more than 5% of the width of said path.

7. Apparatus according to claim 1 wherein each loaf-engaging member is substantially right triangular in shape.

8. Apparatus according to claim 1 wherein said inner edge is bevelled.

9. Apparatus according to claim 1 wherein each of said loaf-engaging members is substantially planar.

10. Apparatus according to claim 9 wherein each of said planar loaf-engaging members is fixed in use, in a substantially horizontal plane.

11. Apparatus according to claim 1 wherein said loaf-engaging members are adjustably attached to said guide members.

12. Apparatus according to claim 1 wherein said loaf-engaging members are attached to said guide means a height above said conveyor means of about 25–75% of the height of a loaf food product to be sliced.

13. Apparatus according to claim 12 wherein said height is approximately 50% of the height of a loaf food product to be sliced.

14. Apparatus according to claim 1 wherein said loaf-engaging area is at the the downstream end of said inner edge of said loaf-engaging member.

* * * * *